United States Patent [19]

Lorang

[11] 4,023,812

[45] May 17, 1977

[54] GOLF SWING WRIST ACTION TRAINING APPARATUS

[76] Inventor: Walter R. Lorang, 2239 W. Maple Road, Walled Lake, Mich. 48088

[22] Filed: Mar. 15, 1976

[21] Appl. No.: 666,881

[52] U.S. Cl. ..... 273/186 A; 273/194 R; 273/183 B; 273/189 R

[51] Int. Cl.[2] ..... A63B 69/36

[58] Field of Search ..... 273/81.2, 165, 183 B, 273/183 D, 186 A, 29 A, 26 B, 194 R, 193 R, 193 A, 193 B, 186 R, 186 C

[56] References Cited

UNITED STATES PATENTS

| | | | |
|---|---|---|---|
| 760,161 | 5/1904 | Smith | 273/165 |
| 2,462,955 | 3/1949 | Glancey | 273/194 R |
| 3,918,721 | 11/1975 | Trask | 273/186 A |
| 3,954,271 | 5/1976 | Tredway | 273/186 A |

*Primary Examiner*—George J. Marlo
*Attorney, Agent, or Firm*—William T. Sevald

[57] ABSTRACT

Golf swing wrist action training apparatus having a leg mounted on a golf club in the area of the player's hands; the leg lies on the off-target side of the shaft and angles sidewise outwardly and endwise upwardly to a point about opposite the juncture of the player's hands on the club. This locates the upper contact end of the leg (in the ball address position of the club) spaced outwardly from the hands in an off-target direction with the shaft extending forwardly from the player's forearms. When the player's hands on the backswing reach about hip level, he cocks his wrists in an off-target direction moving the shaft from the forewardly extending position relative to his forearms to a near right angle position relative to his off-target forearm. This wrist pivot of the shaft swings the attached leg in an arc and brings the contact end of the leg into engagement with the off-target forearm of the player. This shows the player he has fully cocked his wrists. A sound signal "clicker" device is actuated at the contact end of the leg and emits a "click" signal upon a full wrist cock. Upon downswing uncocking of the wrists, the "click" signal again emits at the point of the uncocking. Also, should the player relax his wrist cock inadvertently, the "click" signal so advices him.

6 Claims, 13 Drawing Figures

Fig-2
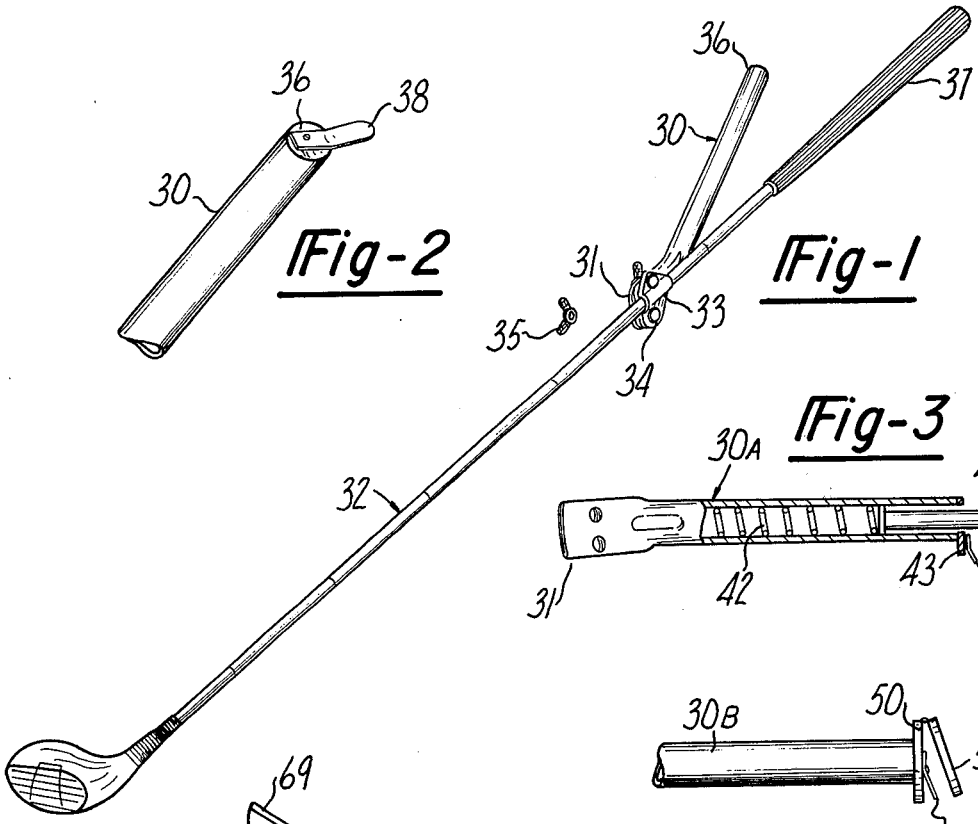
Fig-1
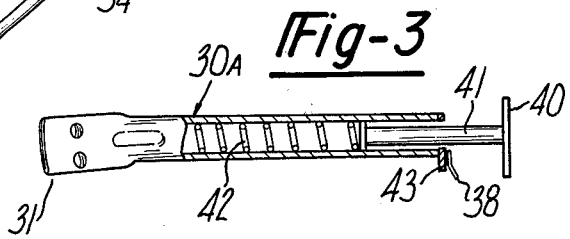
Fig-3
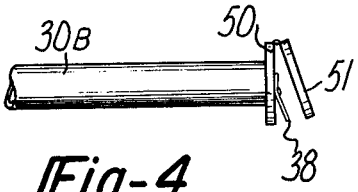
Fig-4
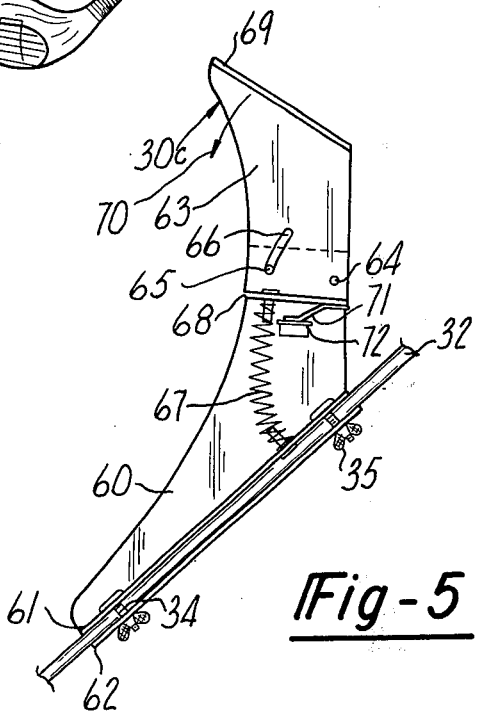
Fig-5
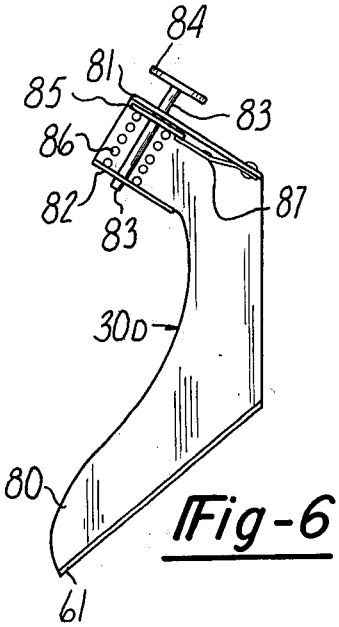
Fig-6

CLICK
CLICK
CLICK
30
32
38

GOLF SWING WRIST ACTION TRAINING APPARATUS

BACKGROUND OF THE INVENTION

The force exerted by the club on the ball is comparable to the speed of the club head at impact with the ball. The hands, arms and body swing of the club produces the base speed of the club head. It is to be noted that the wrists travel at the same relative speed as the hands and club shaft in this base swing. Thus if the wrists are held straight, they neither add or detract from the base speed of the swing.

However, if the wrists are cocked-back from the target on the backswing and then uncocked on the downswing, the club head not only is traveling at the base speed of the arm swing but has an added increment of speed from the swing of the wrists in their uncocking pivot. Thus it is advantageous to have a wrist swing imposed piggy-back on the base arm swing as this greatly accelerates club head speed at impact with the ball.

It is difficult to teach the super-imposition of the wrist swing on the arm swing together with all the other do's and don'ts of golf instruction. Moreover, while the teacher may put the player's hands and wrists through the proper motions, angles and positions, it is quite different from the player doing it himself because he does not get the action and feel of self-performance which is essential to his understanding.

A player is at a great disadvantage if he does not know how to add the velocity of the swing of his wrists to the velocity of his arm swing.

The generally accepted cocked angle of the wrists is that the club shaft lies at a right angle to the off-target forearm of the player. It is also generally accepted that the wrists are cocked on the backswing when the hands reach the level of the hips. The wrists are held cocked during the remainder of the backswing with the left arm straight. The downswing is then entered with the left arm straight and the wrists held cocked until the hands again reach the level of the hips. Then the wrists are uncocked which adds the velocity of the wrist pivot swing to the pivot swing of the arms. This whips the club head through the ball at the combined speeds of the arm swing and the wrist swing.

SUMMARY OF THE PRESENT INVENTION

The apparatus of the present invention is very simple. It avoids adding to the problems which the player already has. The apparatus gives the player the opportunity to experience cocking and uncocking his wrists by his own exertions as the apparatus provides a guide and a scale of reference by which the player can perceive and measure the cocking of his wrists at the proper angle.

Once the player has experienced the exertion and strain of properly cocking his wrists by his own efforts, he has the feel of the situation and now knows what is required of him. He now can add the wrist swing piggy-back on his arm swing to give the club head the combined speed of both swings at impact with the ball.

The apparatus basically is a leg which is attached to the shaft of a golf club at a point below where the player's hands engage the grip portion of the shaft. The leg is mounted on the shaft on the off-target side. The leg extends sidewise from the shaft in the off-target direction. The leg also extends upwardly from the point of attachment to a point about opposite the juncture of the hands on the grip portion. The leg thus has an attachment end and an extending cantilevered end. The latter end is the forearm contact end.

In the ball address position, the forearm contact end lies sidewise of the player's hands a distance about half the length of the player's hand and forearm combined — about 8 to 10 inches. Here the contact end lies on the off-target side of the shaft in the plane of the player's off-target forearm. Here the player—s wrists are straight and not cocked, and the contact end is below the forearm with the shaft projecting as a foreward extension of the forearms.

In the initial portion of the backswing, the player keeps his wrists straight until his hands rise to a point about the level of his hips. At this point the player cocks his wrists in the off-target direction and this swings the shaft from a position as a foreward extension of the forearms to a right angle position to the off-target forearm. This swing of the shaft relative to the off-target forearm also swings the leg. The swing of the leg swings the contact end into engagement with the off-target forearm of the player between the wrist and the elbow. The player feels the exertion to bring the contact end into engagement with his forearm and he also feels the touch of the engagement on his forearm. He now knows that he has cocked his wrists to extend the shaft at about a right angle from his off-target forearm.

After he has cocked his wrists at the level of his hips in the backswing, the player maintains the cock of his wrists to the top of his backswing and still maintains the cock of his wrists in the downswing until his hands again reach the level of his hips. Should he relax the cock of his wrists during these portions of the backswing and the downswing, he will know it from the fact that the contact end will move out of engagement with his forearm and he will lose the feel and/or the touch of the contact end.

Upon the player's hands in the downswing reaching the level of his hips, his arm swing is under way and the club head is traveling at the velocity or speed of the arm downswing. The player now uncocks his wrists and adds the speed or velocity of the swing of the wrist pivot to the velocity of the arm swing at impact of the club head with the ball.

The player maintains his arm swing pivot and wrist uncock pivot after impact with the ball in a follow through swing. In the complete follow through swing, the contact end of the leg will again engage the off-target forearm of the player — but this time on the target side of his body with his off-target arm crossed over his body.

Signal means are provided for advising the player when he has properly cocked his wrists, when he has properly uncocked his wrists, and also when he relaxes his wrists and lets them uncock inadvertently.

The signal means are preferably auditory so that the player can keep his eye on the ball. Signal means are mounted on the contact end of the leg. Also a plunger, hinge and/or other moving part may be mounted at the contact end of the leg. The signal means may be a "cricket" or "clicker" which is mounted in the path of the plunger or other moving part. The signal means itself may contact the forearm. The moving part or clicker is positioned to abut the forearm when the wrists are cocked. Upon a full wrist cock, the moving part activates the clicker and a sharp "click" signals the player that he has fully cocked his wrists. Should the player relax his wrist cock, the clicker or moving part is released and the "click" emits showing the player that he has inadvertently let his wrists uncock. The player in his downswing uncocks his wrists at hip level and when he does the "click" is sounded advising him of the point at which he uncocked his wrists.

The structures embodying the invention and their operation will be more apparent from the accompanying drawing and from the detailed description of the illustrated embodiments hereinafter set forth.

DESCRIPTION OF THE DRAWINGS

FIG. 1 is a side oblique view of a golf club with the novel leg attached thereto below the hand grip and angling upwardly and outwardly on the off-target side (for a right-handed player) to the cantilevered forearm contact end.

FIG. 2 is a partial perspective top side view of the leg and contact end seen in FIG. 1, with the attachment end broken away, and with a signal device "clicker" on the contact end.

FIG. 3 is a partial longitudinal cross-sectional view of the leg seen in FIG. 1 equipped with a spring biased plunger at the cantilevered end and a signal device "clicker" activated by the contact end head on the plunger.

FIG. 4 is a side view of the leg with the attachment end broken away with a hinged contact end on the cantilevered end of the leg and a clicker signal device actuated by the hinged contact end.

FIG. 5 is a plan view of a modified leg with the attached end mounted on a shaft, with the shaft broken away; showing the leg in two pieces which are pivotally interconnected and spring biased; with the contact end cantilevered; and a clicker signal device actuated by the pivotal movement of the contact end relative to the attached end when pivoted against the spring by contact with a player's forearm.

FIG. 6 is a view similar to FIG. 5 with a one-piece leg having a spring biased contact end plunger depressible by contact with a player's forearm to actuate the clicker signal device.

DETAILED DESCRIPTION OF THE ILLUSTRATED EMBODIMENTS

Figures 7, 8, 9, 10, 11, 12, 13:
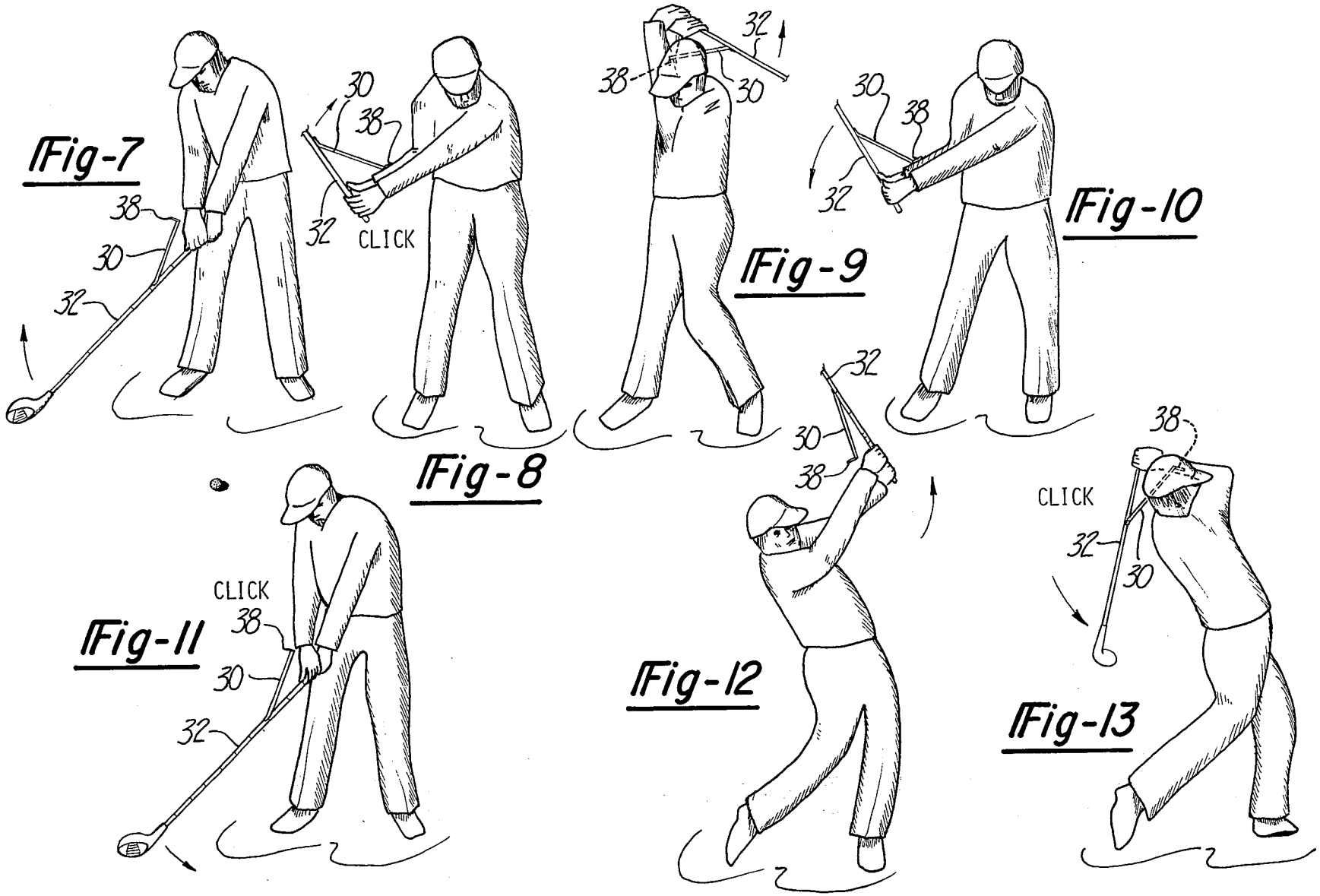
FIG. 7 is a front elevational view of a player using a club equipped with the embodiment of FIG. 2; with the club shaft in a position of the initial portion of the backswing; and the shaft extending forewardly of the forearms.
FIG. 8 is a view similar to FIG. 7, showing the hands at hip level in the backswing; the wrists cocked; with the shaft at a right angle to the off-target forearm; and the contact end in engagement with the off-target forearm actuating the clicker signal device.
FIG. 9 is a view similar to FIG. 8, showing the position at the top of the backswing.
FIG. 10 is a view similar to FIG. 9, showing the position of the hands at a point still above hip level in the downswing.
FIG. 11 is a view similar to FIG. 10, just after the position of the hands has passed the hip level in the downswing with the wrists uncocking.
FIG. 12 is a view similar to FIG. 11, near the end of the foreswing.
FIG. 13 is a view similar to FIG. 12 showing the end of the foreswing with the contact end of the leg again in engagement with the off-target forearm of the player.

Referring now to the drawings wherein like reference numerals refer to like and corresponding parts throughout the several views of the various illustrated embodiment, the golf swing wrist action training apparatus disclosed therein to illustrate the invention comprises a leg 30, FIG. 1. An attaching end 31 on the leg 30 abuts the shaft 32 of a golf club. A clevis 33 lies on the opposite side of the shaft 32. Bolts 34 and nuts 35 urge the attaching end 31 and the clevis 33 toward one another clamping the shaft therebetween thereby mounting the leg 30 on the shaft 32. The leg 30 angles from the attaching end 31 to its cantilevered contact end 36. The leg 30 lies on the off-target side of the shaft 32. The contact end 36 lies about 6 to 10 inches away from the grip portion 37 on the shaft 32 opposite a point on the grip portion 37 about between the hands of a player gripping the club.

The leg 30, FIG. 2, is equipped with a spring steel clicker signal device 38 at the contact end 36 which emits a "click" sound when flexed by engagement with the forearm of a player.

The leg 30A, FIG. 3, has an attaching end 31. A contact end 40 is mounted on a plunger 41 slidably telescoped in the leg 30A. A spring 42 within the leg 30A biases the plunger 41 and contact end 40 outwardly as shown. A clicker signal device 38 is mounted on a flange 43. The flange 43 is attached to the outer end of the leg 30A. When the contact end 40 engages the forearm of a player, the plunger 41 moves into the leg 30A depressing spring 42 and bringing the contact end 40 into engagement with the clicker signal 38 and a signal emits.

A leg 30B, FIG. 4, has an outer end equipped with a flange 50. A contact end 51 is hinged on the flange 50. A clicker signal device lies between the flange 50 and the contact end 51. When the contact end 51 is engaged against the forearm of a player, it swings into pressed engagement against the clicker 38 and a signal emits.

A leg 30C, FIG. 5, comprises an attachment end 60. A flange 61 on the attachment end 60 abuts one side of the shaft 32. A strip 62 abuts the other side. Bolts 34 and nuts 35 urge the flange 61 and strip 62 into pressed engagement with the shaft 32 thereby mounting the attachment end 60. A pin 64 hingedly connects the contact end 63 on the attachment end 60. A slide pin 65 fixed on the attachment end 60 lies in the arcuate slot 66 formed in the contact end 63. The pin 65 and slot 66 limit the outward pivoting of the contact end 63. A spring 67 is based on the flange 61 of the attachment end 60. A flange 68 on the contact end 63 engages the other end of the spring 67. The spring 67 resiliently pivots the contact end outwardly on the pin 64 as limited by the stop pin 65 and slot 66. A flange 69 on the contact end 63 is provided to contact the forearm of a player to pivot the contact end 63 in the direction of the arrow 70. A clicker signal device 71 is fixed on the flange 68 of the contact end 63. An abutment 72 on the attachment end 60 lies in the path of the clicker 71. When the outer contact end 63 is pivoted relative to the attachment end 60, the clicker 71 swings into engagement with the abutment 72 and emits a "click" signaling he player that the flange 69 on the contact end 63 is engaged against his forearm.

The leg 30D, FIG. 6, has an attachment end 80. A flange 61 is formed on the attachment end 80 and attaches to a club shaft 32 the same as the embodiment of FIG. 5. Spaced flanges 81 and 82 are formed on the outer end of the leg 30D. A plunger stem 83 extends through the flanges 81 and 82. A contact end pad 84 lies on the outer end of the stem 83. A collar 85 is fixed on the stem 83 inside the flange 81. A spring 86 based on the flange 82 resiliently biases the collar 85 and stem 83 as seen in FIG. 6 to extend the contact end pad 84 to its out position. A spring steel clicker 87 is fixed on the flange 81 in the path of the collar 85. When the player brings the contact end 84 into engagement with his forearm, the contact end 84 moves endwardly moving he collar 85 against the clicker 87 and a "click" signal emits advising the player that the contact end 84 is in engagement with his forearm.

The apparatus of the invention is usable on any golf club on the off-target side of both left and right handed clubs. With the apparatus of the invention, the novice and expert alike may train his wrist action swing with self-measurable accuracy.

The apparatus gives the player the means to determine the angle of the proper wrist cock, when to cock his wrists, and when to uncock them. The apparatus provides the player with a signal when his wrists are properly cocked and a signal when he uncocks them at the right point in his downswing. It also signals the player upon inadvertent uncocking of his wrists at an improper point in his swing, such as is occasioned by relaxing his wrists or letting his left arm bend.

The apparatus does not interfere with the normal swing of the club nor does it throw the club or the swing out of balance. The apparatus also is highly useful in professional instruction as the pro can demonstrably and accurately show the player exactly what is entailed in the wrist action as he now has a measurement and scale of reference for both himself and the player which they both can see, feel, and/or hear with equal effect. The apparatus provides the picture which words here-to-fore have not been able to get across with operable understanding and execution.

While several modifications have been shown and described, it will be understood that they are not a limitation on the scope of the invention which is defined in the appended claims.

I claim:

1. Golf swing training apparatus to demonstrate the addition of the wrist swing of the club to the arm swing of the club by cocking the wrists during the backswing to pivot the shaft at his hands from a near straight angle relative to his forearms to a near right angle relative to his off-target forearm so when the club head is moving at arm swing velocity in the downswing the wrists can be uncocked to add the velocity of the wrist swing to the velocity of the arm swing at the club head on impact with the ball, comprising, a leg mountable on a club shaft;

said leg having a forearm contact upper end for contacting a player's off-target forearm;

a lower end on said leg for attachment to a club shaft;

an intermediate portion on said leg between said upper end and said lower end;

mounting means on said lower end for attaching said leg to a club shaft;

said lower end of said leg being mounted on a club shaft spaced below both hands of a player when gripping the club with both hands;

said leg when mounted lying in a plane normal to the plane of the club face in a direction opposite to the target direction, said leg when mounted inclining from said lower attached end sidewise outwardly and upwardly in the off-target direction to said upper end;

said intermediate portion being of a length to locate said upper end at point approximately opposite the juncture of the player's hands when gripping the club in the ball address position;

the angle of inclination of said leg being such to locate said upper end spaced sidewise outwardly of a player's hands in an off-target direction a distance sufficient to avoid touching the player's hands during his swing of the club at a ball;

when a player cocks his wrists on his backswing, the angle of inclination of said leg locating said upper end in the area of the off-target forearm of the player for contacting the off-target forearm of the player;

the angle of inclination of said leg relative to a club shaft and the length of said intermediate portion of said leg being coordinated to put the said upper end into contact with the off-target forearm of a player when the cock of his wrists angularly positions the club shaft approximately normal to a player's off-target forearm;

when a player cocks his wrists on the backswing, he pivots the shaft from a near straight angle relative to his forearms of the address position to a near right angle position relative to his off-target forearm in the backswing position and said leg on the shaft swings with the shaft and said contact end of said leg moves from a position sidewise of and below the player's forearm into engagement at a near right angle with the player's off-target forearm and shows the player that he has cocked his wrists;

when a player does not cock his wrists, he is shown by lack of engagement by said contact end of said leg with his off-target forearm that he has failed to cock his wrists.

2. In apparatus as set forth in claim 1, a signal device on said contact end; said signal device emitting a signal upon being engaged with a player's forearm when the wrists are cocked to provided the player with added indication that said contact end is in engagement with his forearm.

3. In apparatus as set forth in claim 1, motion means on said leg movably mounting said contact end;

said contact end being movable via said motion means between an exended position and a depressed position;

spring means biasing said motion means to locate said contact end in the extended position;

said contact end thereby being resiliently movable from said extendedj position to said depressed position by forcing said contact end against the playerd's forearm when the wrists are cocked indicating to the player that said contact end is in engagement with his forearm.

4. In apparatus as set forth in claim 3, a signal device on said leg engageable by said contact end to emit a signal when said motion means are moved to the depressed position to provide added indication to the player that said contact end is in engagement with his forearm.

5. In apparatus as set forth in claim 3, said motion means comprising a plunger resiliently urged to said extended position by said spring.

6. In apparatus as set forth in claim 3, said motion means comprising pivotal hinge means resiliently urged to said extended position by said spring.

* * * * *